US010047504B2

(12) United States Patent
Kunz

(10) Patent No.: US 10,047,504 B2
(45) Date of Patent: Aug. 14, 2018

(54) SHROUD RETENTION SYSTEM HAVING REPLACEABLE LUG INSERT

(71) Applicant: Caterpillar Inc., Peoria, IL (US)

(72) Inventor: Phillip John Kunz, Morton, IL (US)

(73) Assignee: Caterpillar Inc., Deerfield, IL (US)

( * ) Notice: Subject to any disclaimer, the term of this patent is extended or adjusted under 35 U.S.C. 154(b) by 115 days.

(21) Appl. No.: 15/333,244

(22) Filed: Oct. 25, 2016

(65) Prior Publication Data

US 2017/0037603 A1 Feb. 9, 2017

Related U.S. Application Data

(62) Division of application No. 14/193,125, filed on Feb. 28, 2014, now Pat. No. 9,518,379.

(51) Int. Cl.

| | |
|---|---|
| ***E02F 9/28*** | (2006.01) |
| *E02F 3/32* | (2006.01) |
| *E02F 3/40* | (2006.01) |

(52) U.S. Cl.

CPC ..... *E02F 9/2883* (2013.01); *E02F 9/2825* (2013.01); *E02F 9/2833* (2013.01); *E02F 9/2858* (2013.01); *E02F 9/2891* (2013.01); *E02F 3/32* (2013.01); *E02F 3/40* (2013.01)

(58) Field of Classification Search

CPC ..... E02F 9/28–9/2891; E02F 3/32; E02F 3/40

See application file for complete search history.

(56) References Cited

U.S. PATENT DOCUMENTS

| | | | | |
|---|---|---|---|---|
| 4,057,294 | A * | 11/1977 | Krekeler | E02F 9/2816 175/374 |
| 4,282,665 | A * | 8/1981 | Fletcher | E02F 9/2841 299/109 |
| 4,655,508 | A | 4/1987 | Tomlinson | |
| 4,663,867 | A * | 5/1987 | Hahn | E02F 9/2841 37/459 |
| 5,005,304 | A | 4/1991 | Briscoe et al. | |
| 5,088,214 | A | 2/1992 | Jones | |
| 5,172,500 | A * | 12/1992 | Renski | E02F 9/2833 37/457 |
| 5,553,409 | A | 9/1996 | Irving | |
| 5,603,481 | A | 2/1997 | Parker et al. | |
| 5,913,605 | A | 6/1999 | Jusselin et al. | |

(Continued)

FOREIGN PATENT DOCUMENTS

| | | |
|---|---|---|
| JP | 2005061195 | 3/2005 |

OTHER PUBLICATIONS

LEGO, 2001, Rebrickable.com, Part #30622pb02; https//rebrickable.com/parts/30622pb02.

(Continued)

*Primary Examiner* — Robert E Pezzuto
*Assistant Examiner* — Adam J Behrens
(74) *Attorney, Agent, or Firm* — Finnegan, Henderson, Farabow, Garrett & Dunner, LLP

(57) ABSTRACT

A retention system is provided for use in connecting a shroud to a work tool. The retention system may have a mounting boss with a base portion, a shelf portion that overhangs opposing sides of the base portion, and a tapered depression formed within the base portion. The retention system may also have a replaceable lug insert removably disposed within the tapered depression.

8 Claims, 5 Drawing Sheets

(56) References Cited

U.S. PATENT DOCUMENTS

| | | | |
|---|---|---|---|
| 6,041,529 | A | 5/2000 | Ruvang |
| 6,066,407 | A | 5/2000 | Getz |
| 6,209,238 | B1 | 4/2001 | Ruvang |
| 7,762,015 | B2 | 7/2010 | Smith et al. |
| 7,770,310 | B2 | 8/2010 | Keech |
| 8,117,772 | B2 | 2/2012 | Harder et al. |
| 8,122,622 | B2 | 2/2012 | Smith et al. |
| 8,127,475 | B2 | 3/2012 | Harder et al. |
| 8,336,233 | B1 | 12/2012 | Lombardo et al. |
| 8,393,097 | B2 | 3/2013 | Harder et al. |
| 8,397,405 | B2 | 3/2013 | Harder et al. |
| 2003/0007831 | A1 | 1/2003 | Lian et al. |
| 2004/0031175 | A1 | 2/2004 | Hohmann et al. |
| 2004/0216334 | A1 | 11/2004 | Emrich et al. |
| 2005/0120596 | A1 | 6/2005 | Kasim |
| 2005/0229443 | A1 | 10/2005 | Bierwith |
| 2006/0225313 | A1 | 10/2006 | McClanahan et al. |
| 2008/0092413 | A1 | 4/2008 | McClanahan et al. |
| 2009/0166051 | A1 | 7/2009 | Keech |
| 2009/0205227 | A1 | 8/2009 | Stewart |
| 2010/0236109 | A1 | 9/2010 | McClanahan et al. |
| 2011/0119964 | A1 | 5/2011 | Karlsson |
| 2011/0252672 | A1 | 10/2011 | Briscoe et al. |
| 2013/0145659 | A1* | 6/2013 | LaHood ..... E02F 3/8152 37/453 |
| 2013/0185964 | A1* | 7/2013 | Anisy ..... E02F 9/2825 37/453 |
| 2013/0333254 | A1 | 12/2013 | Wallis et al. |
| 2014/0360061 | A1 | 12/2014 | Kunz |
| 2015/0101218 | A1 | 4/2015 | Serrurier et al. |
| 2015/0121729 | A1 | 5/2015 | Kunz |
| 2015/0255835 | A1 | 9/2015 | Koller |

OTHER PUBLICATIONS

LEGO, 2001, Rebrickable.com, Part #30647; https//rebrickable.com/parts/30647.

LEGO, 2004, Rebrickable.com, Part #475041; https//rebrickable.com/parts/47501.

LEGO, 2001, Rebrickable.com, Part #30624; https://rebrickable.com/parts/30624.

LEGO, Part 47757-Wedge 4×4 Pyramid Center, 2006-2010, http://rebrickable.com/parts/47757/wedge-4-x-4-pyramid-center.

Lego, 2001, Rebrickable.com, Part #30621; https://rebrickable.com/parts/30621.

Photo of a coupler pin dated Oct. 7, 2013.

* cited by examiner

SHROUD RETENTION SYSTEM HAVING REPLACEABLE LUG INSERT

RELATED APPLICATION

This application is a divisional application of U.S. application Ser. No. 14/193,125, filed Feb. 28, 2014, the entire contents of which are expressly incorporated herein by reference.

TECHNICAL FIELD

The present disclosure relates generally to a shroud retention system and, more particularly, to a shroud retention system having a replaceable lug insert.

BACKGROUND

Earth-working machines, such as hydraulic excavators, cable shovels, wheel loaders, and front shovels, include work tools generally used for digging into, ripping, or otherwise moving earthen material. These work tools are subjected to extreme abrasion and impacts that cause them to wear. To prolong the useful life of the work tools, shrouds can be connected to the work tools at areas experiencing the most wear. These shrouds are replaceably connected to the work tools.

Historically, shrouds have been connected to the cutting edges of work tools by way of lugs that were welded to or otherwise integrally formed with the cutting edges. Locks inserted through the shroud engaged the lugs and prevented the shrouds from being removed.

The disclosed shroud retention system is directed to improvements over existing retention systems.

SUMMARY

According to one exemplary aspect, the present disclosure is directed to a lug insert. The lug insert may include a body having an upper surface, a lower surface, and a plurality of tapered side surfaces connecting the upper surface to the lower surface. The lug insert may also include at least one lug protruding from the upper surface.

According to another exemplary aspect, the present disclosure is directed to shroud retention system. The shroud retention system may include a mounting boss with a base portion, a shelf portion that overhangs opposing sides of the base portion, and a tapered depression formed within the base portion. The shroud retention system may also include a replaceable lug insert removably disposed within the tapered depression.

According to yet another exemplary aspect, the present disclosure is directed to a shroud assembly for a work tool. The shroud assembly may include a mounting boss configured to be fixedly connected to the work tool, and a replaceable lug insert removably disposed within the mounting boss. The shroud assembly may also include a shroud configured to slide over the mounting boss and replaceable lug insert, and over a cutting edge of the work tool. The shroud assembly may additionally include a lock carried by the shroud and configured to engage the replaceable lug insert.

DETAILED DESCRIPTION

Figure 1:
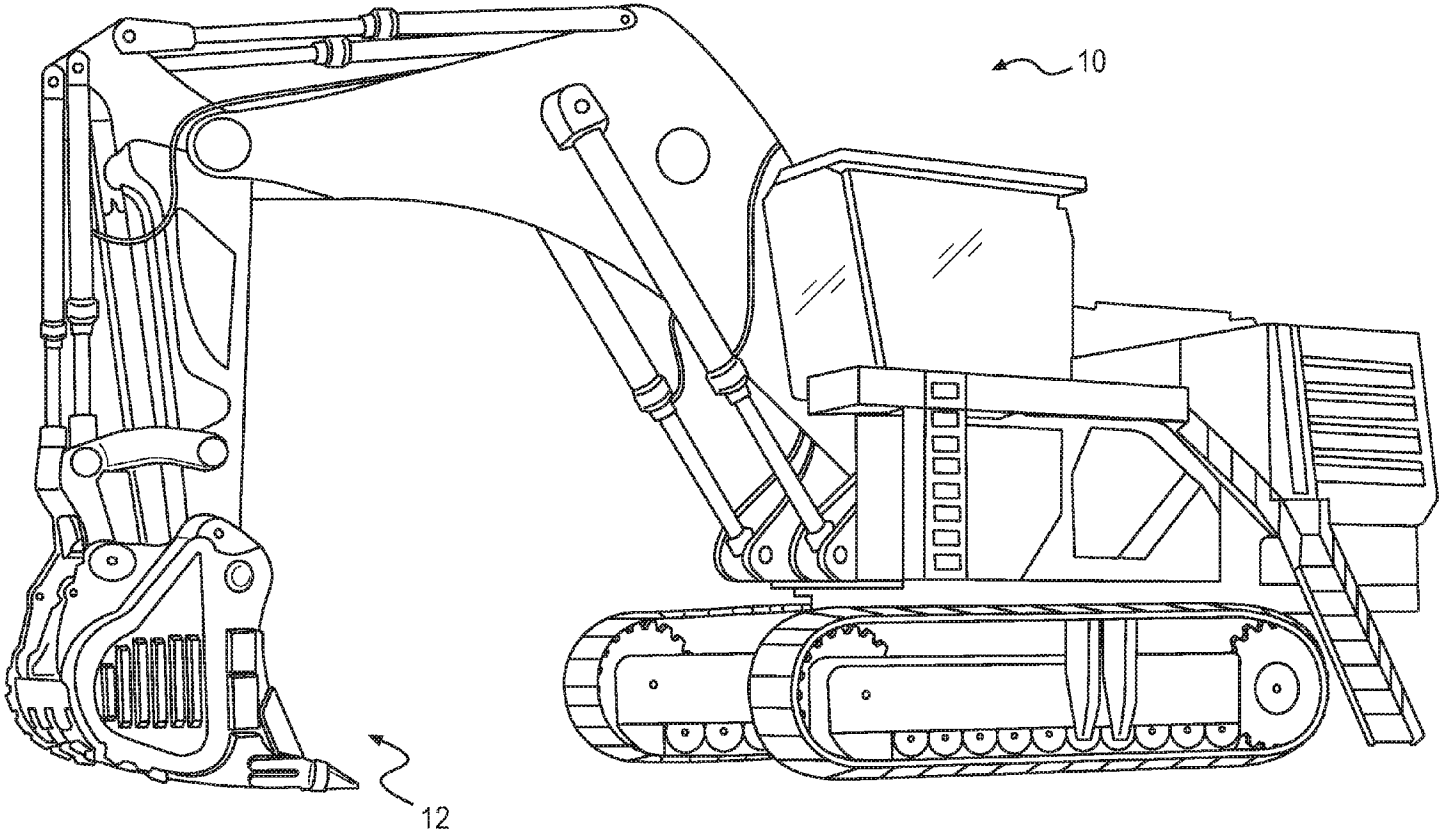
FIG. 1 is an isometric illustration of an exemplary disclosed machine.

FIG. 1 illustrates a mobile machine 10 having a work implement 12 operatively connected at a leading end. In the disclosed embodiment, machine 10 is a hydraulic excavator. It is contemplated, however, that machine 10 may embody any other type of mobile or stationary machine known in the art, for example a cable shovel, a motor grader, a dragline, a dredge, or another similar machine. Machine 10 may be configured to use work implement 12 to move material, such as earthen material, during completion of an assigned task. Although shown as being located at the leading end of machine 10, it is contemplated that work implement 12 could alternatively or additionally be located at a midpoint or trailing end of machine 10, if desired.

Work implement 12 may embody any device used to perform the task assigned to machine 10. For example, work implement 12 may be a bucket (shown in FIG. 1), a blade, a shovel, a crusher, a grapple, a ripper, or any other material moving device known in the art. In addition, although connected in the embodiment of FIG. 1 to lift, curl, and dump relative to machine 10, work implement 12 may alternatively or additionally rotate, swing, pivot, slide, extend, open/close, or move in another manner.

Figure 2:
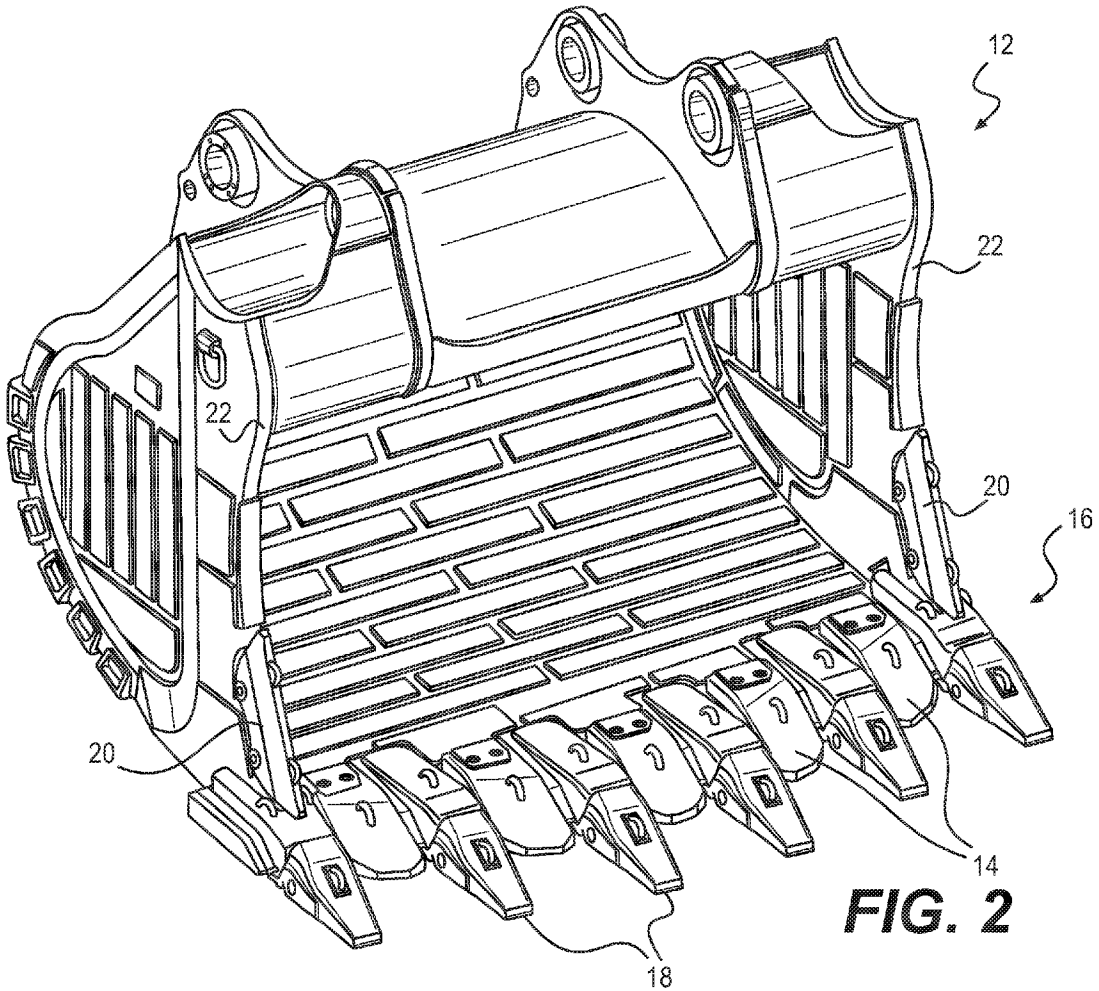
FIG. 2 is an isometric illustration of an exemplary disclosed work tool that may be used in conjunction with the machine of FIG. 1.

As shown in FIG. 2, work implement 12 may be equipped with one or more wear components located around an opening thereof. For example, the disclosed bucket is shown as being provided with multiple edge shrouds 14 that are spaced apart along the length of a cutting edge 16, multiple ground engaging tools (GET) 18 that are located between adjacent edge shrouds 14, and side shrouds 20 that are located at vertical sidewalls 22 of the bucket. Each of these wear components may be replaceable and designed to protect a different portion of work implement 12 from abrasive wear. It is contemplated that any configuration of edge shrouds 14, GET 18, and side shrouds 20 may be associated with work implement 12, as desired. For example, work implement 12 could be equipped with only edge shrouds 14, with only GET 18, or with only GET 18 and side shrouds 20. It is also contemplated that GET 14 could take any form known in the art, for example a fork configuration, a chisel configuration, a hook configuration, or a blunt-end configuration. Other configurations may also be possible.

For the purposes of this disclosure, attention will be focused on attachment of only edge shrouds 14 to work implement 12. It should be noted, however, that the means of attachment that are presented in this disclosure may be equally utilized with the other wear components discussed above and/or with any other wear components known in the art.

Figure 3:
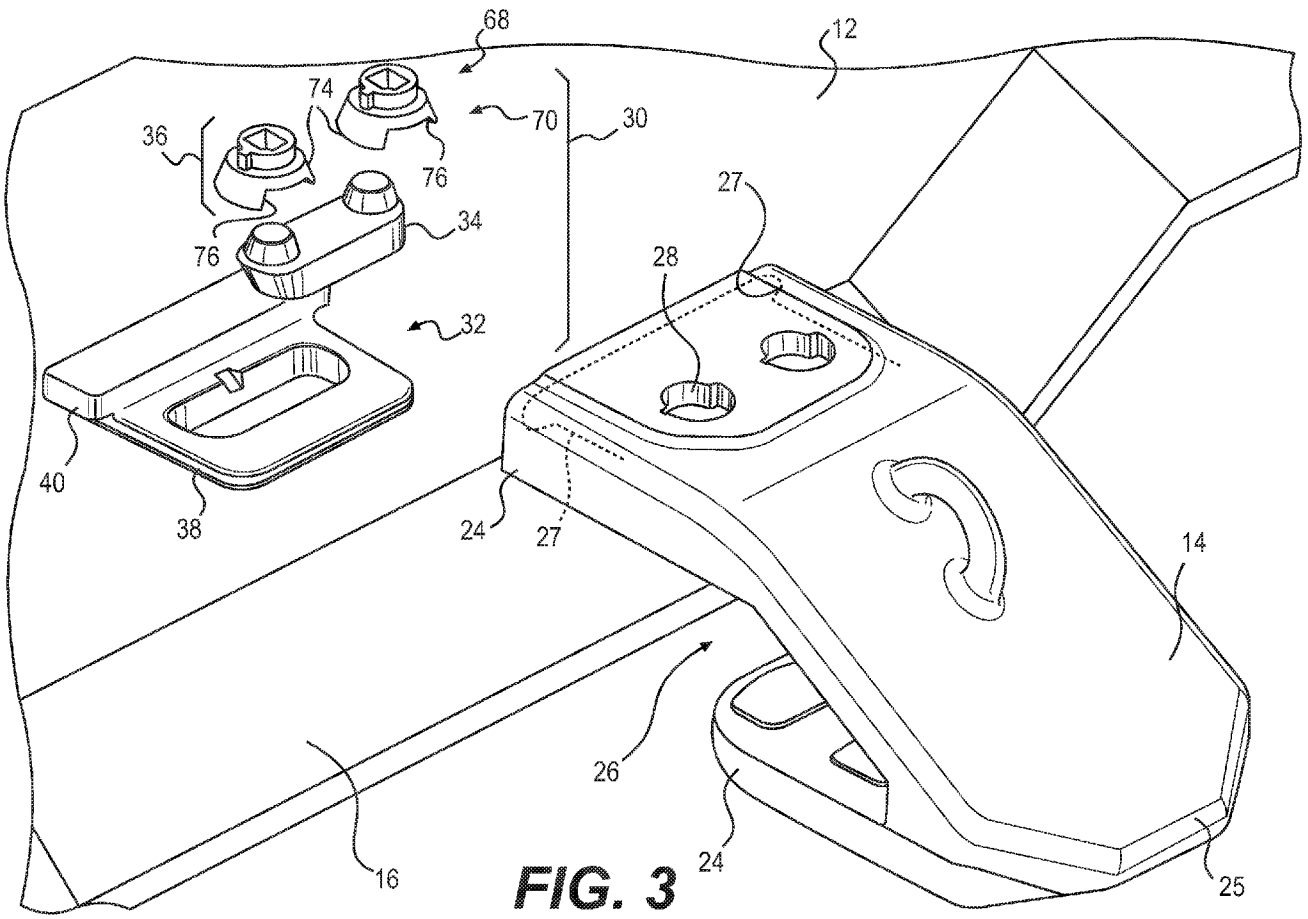
FIGS. 3 and 4 are exploded and cross-sectional view illustrations of an exemplary disclosed shroud assembly that may be used in conjunction with the work tool of FIG. 2.

As shown in FIG. 3, each edge shroud 14 may be generally U-shaped and include legs 24 that extend in a direction away from an external tip 25. Legs 24 may be spaced apart from each other to form an opening 26 therebetween that is large enough to receive cutting edge 16 of work implement 12. The internal one of legs 24 (i.e., the upper leg shown in FIG. 3 that is internal to the bucket) may have a generally C-shaped cross section at a distal end (see dashed lines), such that an internal lip 27 is formed at each edge of the internal leg 24. A pair of spaced-apart (i.e., spaced-apart in a width direction of edge shroud 14) apertures 28 may be formed within the internal one of legs 24.

Each edge shroud 14 may be removably connected to work implement 12 by way of a retention system 30. In this manner, each edge shroud 14 may function as a wear piece at the attachment location, and be periodically replaced when worn or misshapen beyond a desired or effective amount. Retention system 30 may be configured to pass through and engage the surfaces of apertures 28 and cutting edge 16, thereby locking edge shroud 14 to work implement 12.

The exemplary retention system 30 shown in FIG. 3 includes multiple components that interact to clamp edge shroud 14 in a removable manner to cutting edge 16 of work implement 12. Specifically, retention system 30 includes a mounting boss 32, a lug insert 34, and a pair of locks 36. As will be described in more detail below, mounting boss 32 may be welded to an internal surface of cutting edge 16, lug insert 34 may be replaceably nested within mounting boss 32, and locks 36 may pass through apertures 28 to engage lug insert 34.

Figure 4:
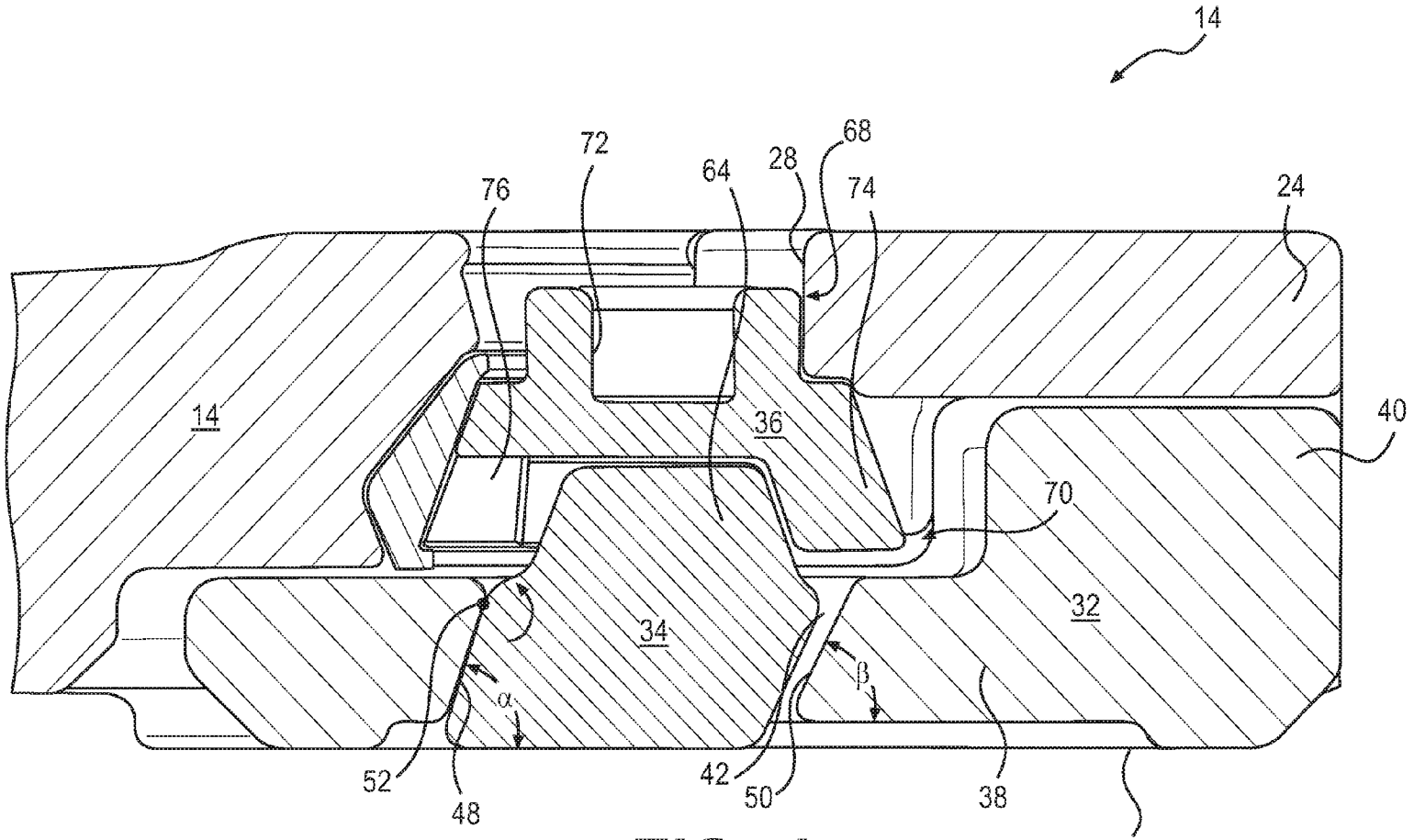
Figure 5:
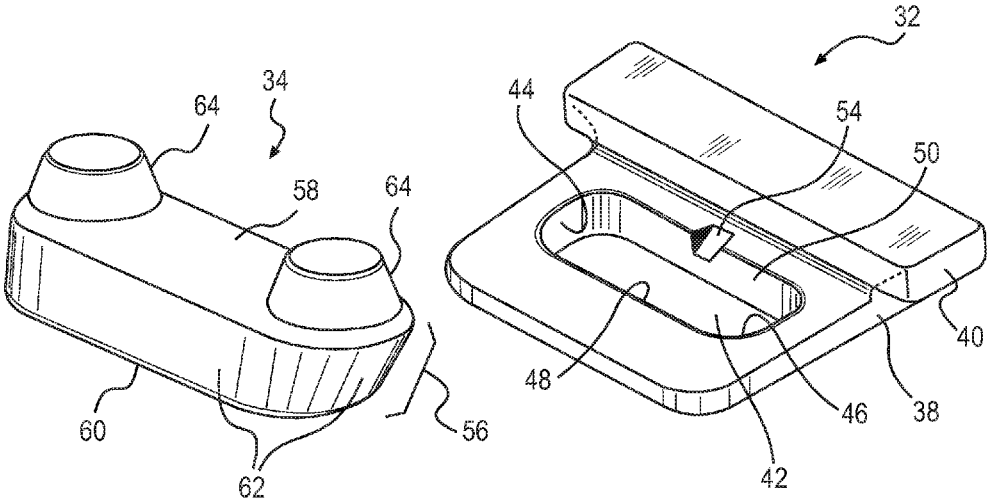
FIGS. 5-7 are isometric and cutaway view illustrations of an exemplary disclosed retention system that may be used in conjunction with the shroud assembly of FIGS. 3 and 4.

As shown in FIGS. 4 and 5, mounting boss 32 may include a base portion 38 and an integral shelf portion 40. Base portion 38 may be generally plate-like, rectangular in shape, and welded around its periphery to cutting edge 16 (with shelf portion 40 located away from cutting edge 16). A tapered depression 42 may be formed within base portion 38, and extend in a length direction thereof. Tapered depression 42, in the depicted example, passes completely through base portion 38. It is contemplated, however, that tapered depression 42 may have a depth less than a thickness of base portion 38, if desired. In other words, base portion 38 may form a floor of tapered depression 42 in some applications.

Tapered depression 42 may have four generally planar internal surfaces, including left and right side surfaces 44, 46 (shown only in FIG. 5), a front surface 48, and a rear surface 50. Each of surfaces 44, 46, and 50 may taper inward, such that an area at a floor of tapered depression 42 is smaller than an area at an external opening. Front surface 48, however, may taper outward to lie in the same general orientation as rear surface 50 (see FIG. 4). In one example, an inner taper angle $\alpha$ of front surface 48 may be greater than an inner taper angle $\beta$ of rear surface 50. For example, $\alpha$ may be about 75° and $\beta$ may be about 70°. As will be described in more detail in the following section, this configuration of angles may allow clearance for a unique limited rotation of lug insert 34 about a pivot axis 52 during loading by edge shroud 14 and locks 36.

Shelf portion 40 of mounting boss 32 may be located at an inner most edge of base portion 38 (relative to the opening of work tool 12), and extend in a length direction of base portion 38 generally parallel to tapered depression 42 and cutting edge 16. Shelf portion 40 may overhang opposing ends of base portion 38 to create openings between the overhang and the inner surface of cutting edge 16. As will be described in more detail below, lips 27 located at the distal end of edge shroud 26 may be configured to slide into these openings, thereby inhibiting the distal end from separating away from cutting edge 16 toward an interior of work implement 12.

In the disclosed embodiment, the openings formed by the overhang of shelf portion 40 may each have a generally square shape. That is, the openings may have about the same height from a proximal end of the overhang to a distal end. However, it is contemplated that the overhang of shelf portion 40 could alternatively have a dove-tail shape (shown with dashed lines in FIGS. 5-7), if desired. Specifically, the height of the openings formed by the overhang may increase toward the distal end. The dove tail shape may, in some applications, improve ease of assembly.

Mounting boss 32 may also include one or more features that facilitate disassembly. For example, a recess 54 may be formed at least partially within tapered depression 42, at a lengthwise center of rear surface 50. Recess 54 may provide clearance for a removal tool used to pry lug insert 34 from tapered depression 42.

Figure 6:
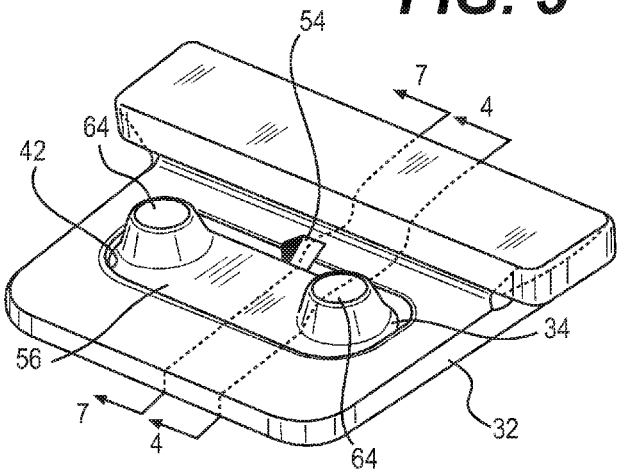

As shown in FIGS. 4 and 6, lug insert 34 may be placed within tapered depression 42 and used to create reactionary forces that resist the sliding removal of edge shroud 14 from work tool 12. Lug insert 34 may include a body 56 (shown in FIG. 5) having an upper surface 58, a lower surface 60 that is generally parallel with upper surface 58, and a plurality of tapered side surfaces 62 connecting upper and lower surfaces 58, 60. The taper angles of side surfaces 62 may generally match the angles of tapered depression 42. For example, the opposing shorter side surfaces of body 56 may be angled in opposition to each other such that lower surface 60 is shorter than upper surface 58, and the opposing longer side surfaces may be oriented in the same general direction (but non-parallel) at angles $\alpha$ and $\beta$, respectively (see FIG. 4).

Two lugs 64 may protrude from upper surface 58 at locations spaced apart in a length direction of body 56. Lugs 64 may have a generally frustoconical (shown) or cylindrical shape (not shown), and extend out of tapered depression 42 a distance that is less than a height of shelf portion 40 (see FIG. 4). In other words, a distal end surface of lugs 64 may be located elevationally about midway between upper surface 58 of body 56 and an upper surface of shelf portion 42, when fully assembled.

Figure 7:
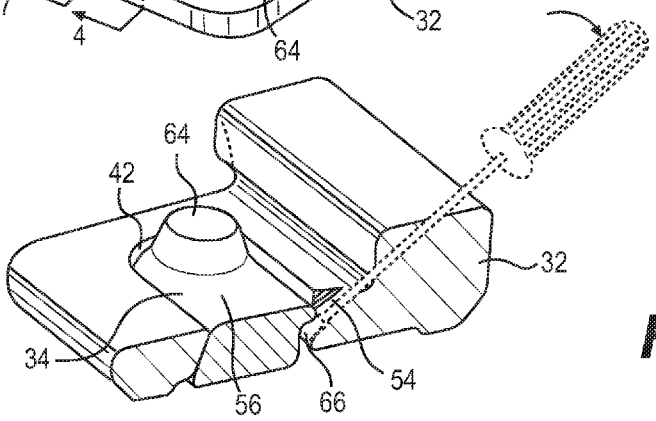

As shown in FIG. 7, a recess 66 may be formed within body 56 of lug insert 34 to aid in the removal of lug insert 34 from mounting boss 32. In the disclosed embodiment, recess 66 is located about midway along the length of side surface 62, in general alignment with recess 54 in mounting boss 32. With this configuration, a tip of the removal tool may pass through recess 54 and engage a lip at an edge of recess 66.

Locks 36 may include features that function to lock edge shroud 14 to cutting edge 16 of work tool 12. Referring to FIGS. 3 and 4, each lock 36 may be carried within apertures 28 of edge shroud 14, and include a tool engagement side 68 oriented out of aperture 28 and a lug engagement side 70 located in opposition to tool engagement side 68. Tool engagement side 68 of lock 36 may include structure intended to be engaged by a tool, allowing rotation of the tool to turn the corresponding lock 36. In the disclosed example, each lock 36 includes a recess 72 (e.g., a square or hexagonal recess) configured to receive a tool shank. It is contemplated, however, that each lock could alternatively or additionally include a head configured to be received by a socket or other similar tool. Lug engagement side 70 of lock 36 may include an annular skirt 74 having an opening 76 at one side. Each lock 36 may initially be inserted through apertures 28 of edge shroud 14 with opening 76 facing shelf portion 40, and then rotated through about 180° to lock edge shroud 14 in place. When locks 36 are rotated to their locked positions, rearward sliding of edge shroud 14 away from cutting edge 16 may cause surfaces of apertures 28 to transmit forces through skirts 74 of locks 36, through lugs 64, and through mounting boss 32 into cutting edge 16 of work tool 12.

INDUSTRIAL APPLICABILITY

The disclosed tool retention system may be applicable to various earth-working machines, such as hydraulic excavators, cable shovels, wheel loaders, front shovels, draglines, and bulldozers. Specifically, the tool retention system may be used to removably connect wear components, particular edge shrouds, to the work implements of these machines. In this manner, the disclosed retention system may help to protect the work implements against wear in areas experiencing damaging abrasions and impacts. Use of tool retention system 30 to connect edge shroud 14 to work implement 12 will now be described in detail.

To connect edge shroud 14 to work implement 12, a service technician may first weld mounting boss 32 to cutting edge 16, with shelf portion 40 located away from cutting edge 16 and in an orientation generally parallel to cutting edge 16. Mounting boss 32 may be welded around an entire periphery of base portion 38. It is contemplated, that in some applications, mounting boss 32 could be integrally formed together with cutting edge 16, if desired.

The service technician may then place lug insert 34 into tapered depression 42, with recess 66 immediately adjacent and aligned with recess 54 in mounting boss 32. When servicing an existing edge shroud 14, the service technician may first be required to pry out an existing and worn lug insert 34 before a new lug insert 34 may be placed into tapered depression 42. The worn lug insert may be removed by placing the tip of a tool (e.g. a flat head screwdriver) through recess 54 and into recess 66 to engage a lip at the edge of recess 66. The free end of the tool may then be used as a lever to wrest the existing lug insert 34 free of mounting boss 32. In some instances, recesses 54 and 66 may first need to be cleaned of debris before the tool can be used.

Once a new lug insert 34 has been placed within mounting boss 32, edge shroud 14 may be moved into position. In particular, legs 24 may be placed over opposing sides of cutting edge 16, and lips 27 aligned with the openings at the overhang of shelf portion 40. Edge shroud 14 may then be slid inward toward cutting edge 16, until apertures 28 are generally aligned with lugs 64 and lips 27 wrap around and are secured under the overhanging ends of shelf portion 40. Because of the height of lugs 64 being lower than the height of shelf portion 40, edge shroud 14 may pass over lugs 64 without interference.

Locks 36 may then be inserted through apertures and over lugs 64, with openings 76 facing away from shelf portion 40. A tool (not shown) may then be used to rotate locks 36 through a half-turn, until openings 76 are facing shelf portion 40.

Edge shroud 14 may be inhibited from disconnection via shelf portion 40 and lugs 64. In particular, lips 27 may be sandwiched between the overhanging ends of shelf portion 40 and the inner surface of cutting edge 16. In this configuration, edge shroud 14 may be inhibited from movement inward and away from cutting edge 16. In addition, an outward sliding movement of edge shroud 14 away from cutting edge 16 may cause internal surfaces of apertures 28 to apply pressure to the tool side of locks 36. Skirts 74 of locks 36 may then, in turn, engage the frustoconical surfaces of lugs 64 and push them into front surface 48 of tapered depression 42. This motion may then transmit forces through mounting boss 32 and into cutting edge 16 of work tool 12.

When skirts 74 of locks 36 engage the frustoconical surfaces of lugs 64, it may be possible for only line contact to occur. That is, it may be possible for only a distal edge of each lug 64 to be engaged by the inner surface of a corresponding skirt 74. If this were to occur, the tip of lugs 64 could wear prematurely. However, because of the clearance provided within tapered depression 42 by the difference in tapered angles $\alpha$ and $\beta$ of front and rear surfaces 48, 50, lug insert 34 may be allowed to rotate outward (i.e., in a counterclockwise direction when viewed from the perspective of FIG. 4) about axis 52 somewhat when engaged by locks 36. This outward rotation may facilitate surface contact (as opposed to edge contact) between lugs 64 and skirts 74 of locks 36. And surface contact may help to distribute loading over a greater area of lugs 64, thereby reducing wear at the distal edges of lugs 64.

The disclosed retention system may be help to reduce operating costs and downtime of machine 10. Specifically, the surface contact provided by the limited rotation of lug insert 34 may extend the useful life of edge shroud 14, thereby also reducing the operating costs of machine 10. In addition, when lugs 64 wear beyond a threshold amount, only the existing lug insert 34 may need to be replaced. And this replacement may not require any cutting, welding, or other time-consuming processes. Accordingly, the effort involved in the replacement may be low, allowing for reduced downtime of machine 10.

It will be apparent to those skilled in the art that various modifications and variations can be made to the disclosed retention system. Other embodiments will be apparent to those skilled in the art from consideration of the specification and practice of the disclosed retention system. It is intended that the specification and examples be considered as exemplary only, with a true scope being indicated by the following claims and their equivalents.

What is claimed is:

1. A shroud retention system, comprising:

a mounting boss having a base portion, a shelf portion that overhangs opposing sides of the base portion, and a tapered depression formed within the base portion; and a replaceable lug insert removably disposed within the tapered depression, wherein the replaceable lug insert includes:

a body having an upper surface, a lower surface, and a plurality of tapered side surfaces connecting the upper surface to the lower surface;

the upper surface being generally parallel with the lower surface;

the plurality of tapered side surfaces including a pair of opposing shorter side surfaces angled in opposition to each other such that the lower surface is shorter than the upper surface, and a pair of opposing, non-parallel, longer side surfaces, wherein a front one of the pair of opposing longer side surfaces forms a first, acute angle with the lower surface and a rear one of the pair of opposing longer side surfaces forms a second, obtuse angle with the lower surface such that the first, acute angle is greater than the difference between 180° and the second obtuse angle; and at least one lug protruding from the upper surface.

2. The shroud retention system of claim 1, wherein the shelf portion forms generally square openings at the opposing sides of the base portion.

3. The shroud retention system of claim 1, wherein the shelf portion forms openings having a generally dove-tail shape at the opposing sides of the base portion.

4. The shroud retention system of claim 1, wherein the shelf portion is elongated and disposed along an internal lengthwise edge of the base portion.

5. The shroud retention system of claim 1, wherein the tapered depression is generally parallel with the shelf portion.

6. The shroud retention system of claim 1, wherein:

the mounting boss includes a first recess formed within a side of the tapered depression; and the replaceable lug insert includes a second recess formed within one of the plurality of tapered side surfaces and generally aligned with the first recess in the mounting boss, wherein the first and second recesses are configured to receive a removal tool.

7. The shroud retention system of claim 6, wherein taper angles of the plurality tapered side surfaces generally match corresponding angles of the tapered depression.

8. The shroud retention system of claim 1, wherein the replaceable lug insert includes two lugs spaced apart in a length direction and extending to a height between upper surfaces of the base portion and the shelf portion.

* * * * *